US006536815B1

(12) United States Patent
Liroff

(10) Patent No.: US 6,536,815 B1
(45) Date of Patent: Mar. 25, 2003

(54) TAMPER EVIDENT CARGO SEAL

(76) Inventor: Jeffrey Howard Liroff, 11350 NW. 36 Ter., Miami, FL (US) 33178

( * ) Notice: Subject to any disclaimer, the term of this patent is extended or adjusted under 35 U.S.C. 154(b) by 0 days.

(21) Appl. No.: 09/760,691

(22) Filed: Jan. 16, 2001

(51) Int. Cl.[7] ..... E05C 19/18
(52) U.S. Cl. ..... 292/259 R; 292/1
(58) Field of Search ..... 292/327, 259 R, 292/289, 1; 70/211, 212, 439, 440, DIG. 59

(56) References Cited

U.S. PATENT DOCUMENTS 3,863,968 A * 2/1975 Fraser ..... 292/260
4,944,172 A * 7/1990 Evans ..... 24/30.5 W
5,217,263 A * 6/1993 Peterson ..... 292/112
5,895,075 A * 4/1999 Edwards ..... 283/100
6,070,918 A * 6/2000 Calvache, Jr. ..... 292/DIG. 47
6,113,163 A * 9/2000 Liroff ..... 292/307 R
6,149,203 A * 11/2000 Hanlon ..... 283/101

* cited by examiner

*Primary Examiner*—J. J. Swann
*Assistant Examiner*—Thomas Ho
(74) *Attorney, Agent, or Firm*—Malloy & Malloy, P.A.

(57) ABSTRACT

A tamper evident cargo seal to securely close a cargo container having a pair of doors and at least two spaced apart lock rods, the tamper evident cargo seal including a pair of retention assemblies disposed in engaging relation with the lock rods on opposite sides of a perimeter edge of the door and a cross brace including a generally elongate, rigid construction which is cooperatively associated with the retention assemblies so as to maintain the seal in engagement with the lock rods and prevent removal therefrom, and so as to secure the cross brace in closing relation across the perimeter edge of the door. A lock assembly is provided to secure the cross brace with the retention assemblies, to the container, and at least the cross brace includes a continuous surface pattern defined thereon which is structured to visibly indicate a severing of the cross brace therethrough and a subsequent re-attachment.

11 Claims, 3 Drawing Sheets

TAMPER EVIDENT CARGO SEAL

BACKGROUND OF THE INVENTION

1. Field of the Invention

The present invention relates to a tamper evident cargo seal that is utilized to effectively close and secure the doors of a cargo container in a manner which makes it very difficult and/or impossible to open the cargo container without affirmatively removing the tamper evident cargo seal. Furthermore, the tamper evident cargo seal is configured such that any tampering therewith so as to permit access to the cargo container by opening the doors will be clearly evident, even in circumstances wherein the cargo seal is replaced on the cargo container after its contents have been removed.

2. Description of the Related Art

Large, cargo containers, such as those that are detachable or are formed as part of trailers are the most commonly used means of transporting large volumes of many varying cargos from location to location around the world. A primary advantage to their use is that the large containers can store large quantities of goods and can be effectively transported on boats, trains, and/or trucks in order to expeditiously arrive at their eventual destination. The detachability and adaptability of containers is of particular importance because the containers will often change hands from one carrier to another carrier, such as from a train to a truck or from a trucking company to a steamship line, during the various legs of a transport route.

Naturally, due to the great volume and often valuable nature of the cargos being transported in the large containers, security is an important consideration when dealing with cargo transportation. Unfortunately, however, one of the most prevalent security concerns, in addition to the third party hijackers or thieves who do not generally care if they leave signs of a break in, involves internal, not obviously detectable theft. For example, it is sometimes an all too common occurrence that during transit, an individual placed in custody, of the container, such as a truck driver in charge of transporting the cargo from point to point, is behind a robbery. Such an individual is naturally very familiar with the nature of the cargo on board, and can easily arrange for a safe rendezvous for the removal of all or part of the cargo contained within the large container. Unlikely as it may seem, in these instances, it is often the security measures and/or locks which are normally employed that serve as the biggest allies to the thieves.

A conventional, single-use, single end seal is the common article used to secure the door handle/latch in a door closing orientation. Moreover, this is the primary seal, and more likely the only seal that is looked at by shipping personnel assigned to verify the integrity of a shipment during transit. Unfortunately, thieves have still found ways to unlatch the doors without actually breaking the seal. Specifically, the joint between the actuation handle and the lock rod on most conventional containers generally incorporates a single bolt or rivet securing both elements with one another. As a result, a thief can merely cut or drill out and remove that bolt or rivet to permit the independent turning of the lock rod while the actuation handle remains in place, thereby opening the container without having to move the actuation handle or break the seal. Once the cargo has been removed and the door is re-closed, a replacement bolt is merely inserted to connect the actuation handle with the lock rod, and can be painted over if necessary to preserve the original appearance. As a result, the conventional type identifying seal has never been removed and no evidence of tampering is available as the cargo changes hands from one carrier to another. Accordingly, when the specific carrier involved in the theft arrives at a next leg of the transport, the container looks normal and intact, and the responsibility is passed on to the next transport carrier. Naturally, when the theft is ultimately discovered, blame passes from carrier to carrier with no concrete resolution as to the true thieves or the actual stage of transport during which the theft occurred. Moreover, as no positive blame can be put on any particular carrier, it is often the owner of the cargo who must take the loss and must fight their insurance company for some recovery.

Despite the numerous techniques thieves have found to defeat existing systems, and because of the high volume of cargo being transported on a daily basis, and the cost of more extensive security measures, most carriers still utilize the above-described securing methods to seal the cargo doors. Such carriers accept a certain percentage of losses to theft as an expense of doing business given the lack of a viable alternative. Accordingly, it would be highly beneficial to provide a cargo container seal and door lock which can defeat or at least significantly hinder the "inside job" theft in a cost effective and easy to implement fashion. Such an improved seal should be structured so as to resist opening of the doors without its removal, and should be difficult to replace without providing substantially clear and noticeable evidence of tampering, thereby allowing the identification of a theft by a transport company when they take on the cargo.

For these reasons, many exporters have turned to larger, more elaborate cargo container seals that work in conjunction with and/or in association with the single use seal containing a serial number. For example, these additional sealing assemblies often involve the positioning of a rigid segment across the door opening such that the rigid element itself physically prevents opening of the doors whether or not the lock assembly has been altered so as to effectively unlock the doors. While such techniques appear to provide a greater effect and deterrent to the general opening of the cargo containers in an unidentifiable manner, clever thieves have nevertheless still been able to effectively defeat such security measures. Indeed, often when such additional brace type security measures are employed, a generally more lax attitude might be exhibited wherein only the serial number is examined and no other inspection for tampering is performed.

Looking specifically to systems that include a rigid segment helping to maintain the doors closed, the primary manner in which thieves have in the past been able to defeat such systems involve the mere cutting and/or severing the elongate segment once the cargo container door has been unlatched and/or unlocked. Furthermore, such elongate segments are generally formed of a single rigid piece of metal. As such, a common occurrence involves the cutting and/or severing of the elongate rigid segment at a generally inconspicuous point, and subsequent to removal of the container's contents, the repositioning of the elongate segment and the re-welding thereof into a single integral piece. Indeed, such welding techniques are rather quick, and once performed sanding, grinding and/or other simple surface treatments can provide a substantially smooth conforming connection that is not readily identified. This is further compounded if a paint can be used to match the surrounding metal portions and further conceal the weld.

As such, it would be highly beneficial to provide a tamper evident cargo seal which not only functions to affirmatively retain the doors in a closed orientation regardless of whether the doors' own locking or latching structures are able to be bypassed, but which also operates in a fashion which is very difficult to tamper with and bypass in a manner which cannot be detected. Additionally, such a tamper evident cargo sealing assembly should also maintain a generally cost effective status so as to not require significant cost increases in order to provide the desired tamper evident and highly secured sealing of the cargo container.

SUMMARY OF THE INVENTION

The present invention relates to a tamper evident cargo seal. In particular, the tamper evident cargo seal is preferably structured for use with a cargo container of the type having at least one door and at least two spaced apart lock rods, and thereby functions to effectively secure the cargo container and maintain the door in a closed position.

In particular, the tamper evident cargo seal includes a preferably elongate, rigid cross brace structured to span a perimeter edge of the door when secured to the cargo container. Further included and cooperatively associated with the cross brace are a pair of retention assemblies. The retention assemblies are structured to engage the cargo container and to thereby maintain the cross brace in its spanning position across the perimeter edge of the door. As can be appreciated, this spanning position prevents opening of the door as it will abut the cross brace when an attempt to open the door is made.

A lock assembly is further provided so as to effectively secure the retention assemblies in engaging relation with the cargo container, and thereby maintain the cross brace properly positioned. Accordingly, in order to gain access to the cargo container, either the lock assembly must be removed or the cross brace or retention assemblies must be physically tampered with.

In order to visibly indicate tampering with at least the cross brace, the cross brace also preferably includes a continuous surface pattern defined thereon. In particular, the continuous surface pattern preferably defines a visible and identifiable pattern on a surface of the cross brace such that a severing of the cross brace through surface pattern and a subsequent re-attachment of the sections, such as by welding, will be readily visible to an observer. In this regard, the continuous surface pattern will preferably be sufficiently detailed so as to be very difficult to easily repair in manner that returns the original, undisturbed appearance.

These and other features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1A:
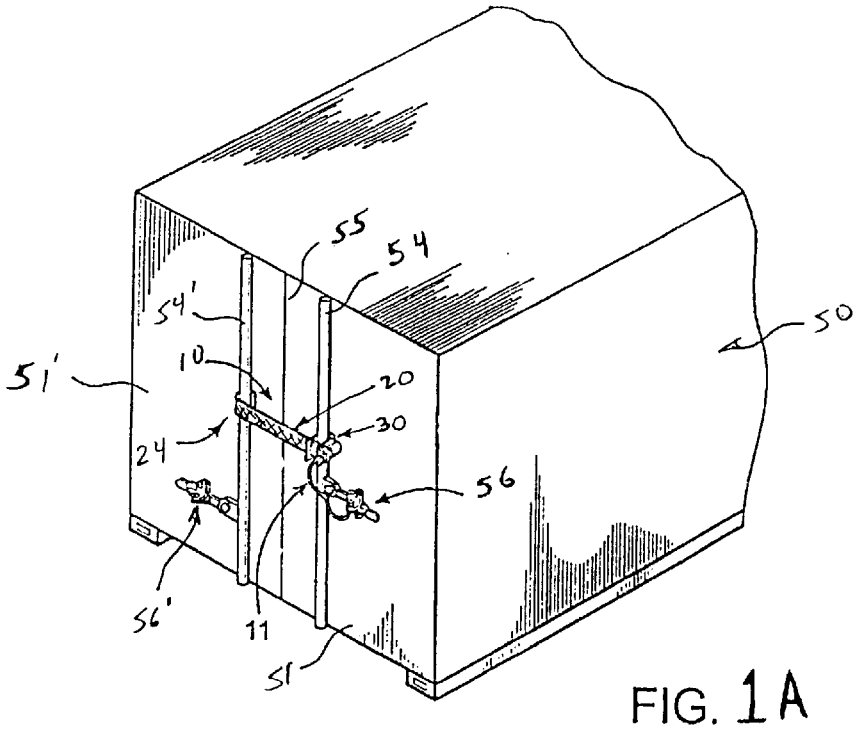
FIG. 1A is a perspective illustration of a rear door portion of a cargo container including one embodiment of the tamper evident cargo seal of the present invention disposed thereon.

The present invention is directed towards a tamper evident cargo seal, generally indicated as 10. The tamper evident cargo seal 10 is preferably provided for use with a variety of commonly used cargo containers wherein a variety of different types of articles are transported from location to location. Furthermore, the tamper evident cargo seal 10 is preferably, although not necessarily structured for use with a cargo container 50 of the type which includes one or more rear doors 51, 51' that are secured in a closed orientation by a latching assembly. The latching assembly typically includes corresponding lock rods 54, 54' and latching structures 56, 56' that cooperate therewith.

Before beginning a discussion of the specific construction and operating of the tamper evident cargo seal 10 of the present invention, a discussion of the normal operation of the cargo container and its latching structure is warranted. Specifically, each door, 51, 51' of the cargo container generally includes a lock rod 54, 54' which protrudes from and often spans, usually vertically, each door 51, 51'. The lock rods 54, 54' provide for effective securing and maintenance of the corresponding doors 51, 51' in their closed orientation.

Communicatively associated with preferably each of the lock rods 54, 54' are latching structures 56, 56'. Specifically, the latching structures 56, 56' are structured to be utilized so as to pivot the lock rods 54, 54', thereby resulting in an unlocking of the cargo container doors 51, 51' and allowing their subsequent opening. Traditionally, the latching structures 56, 56' of the cargo container 50 are maintained in a closed, latched orientation by a single use cargo seal of the type which once secured in placed cannot be removed without breakage. As previously indicated, however, thieves have found ways to effectuate the rotation of the lock rods 54, 54' and therefore the unlocking of the cargo container doors 51, 51' without requiring movement of the latching structures 56, 56'. As such, the present tamper evident cargo seal 10, as will be described, effectively maintains the doors in a closed orientation, preventing opening thereof regardless of whether the lock rods 54, 54' have been utilized so as to unlock the doors 51, 51'.

Looking in detail to the tamper evident cargo seal 10, it preferably includes a cross brace 20. The cross brace 20 is preferably generally elongate and is made of a strong rigid construction, such as from a metallic material including steel. The cross brace 20 is structured to generally span the perimeter edge 55 of the doors 51, 51' and be secured in place so as to prevent opening of the door(s).

In order to effectively secure the cross brace 20 in its scanning position across the perimeter edge 55 of the door 51, a pair of retention assemblies are further provided. The retention assemblies, which can include a variety of configurations are preferably disposed on opposite sides of the perimeter edge 55 of the door 51, and are preferably structured to be cooperatively associated with opposite ends of the cross brace 20. It is of course recognized that the retention assemblies need not be disposed directly at the extremities of the cross brace. Moreover, as will be described, it is contemplated that a variety of different types of retention assemblies which effectively engage the cargo container may be utilized so as to effectively secure the cross brace 20 in position.

Figure 1B:
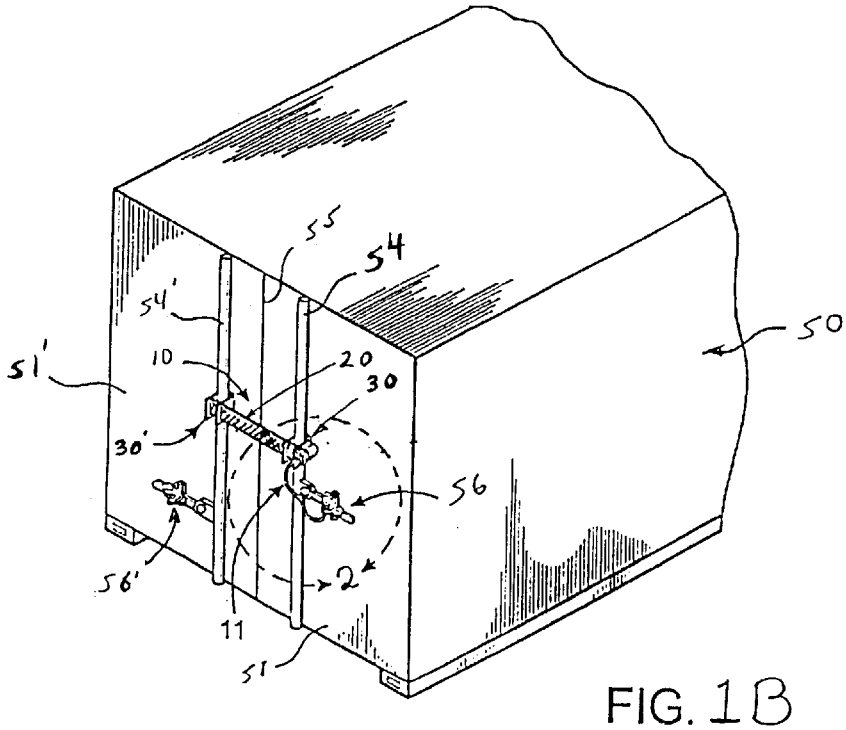
FIG. 1B is a perspective illustration of a rear door portion of a cargo container including another embodiment of the tamper evident cargo seal of the present invention disposed thereon.

For example, looking specifically to FIG. 1B, the retention assemblies may include a pair of retention brackets 30, 30'. The retention brackets 30, 30' are structured to be positioned in engaging relation the cargo container 50, and most commonly with the lock rods 54, 54'. In this regard, it is understood that the retention brackets 30, 30', as with any type of retention assemblies, may be disposed so as to engage any fixed portion of the cargo container, a primary requirement being that they be disposed on opposite sides of a perimeter edge, such as 55, of the container doors 51, 51' which will be maintained secured so as to effectively hold the cross brace 20 in place. Of course, it is also recognized that both retention brackets 30, 30' may be effectively disposed on the same side of a corresponding perimeter edge 55 so long as the remaining portions of the tamper evident cargo seal 10, such as the cross brace 20, still extends over the perimeter edge 55 and sufficient leverage is maintained so as to prevent the door from opening. This configuration may be particularly beneficial when the un-latching of one of the doors requires the actual opening of the other door.

In the embodiment of FIG. 1B, the cross brace 20 actually engages the retention brackets 30, 30' at generally opposite ends thereof. In engaging the retention brackets 30, 30', it is the cross brace 20 that actually ensures that the retention brackets 30, 30' remain engaged and secured to the cargo container 50, and in the illustrated embodiment, to the lock rods 54, 54'. Along these lines, each of the retention brackets 30, 30' preferably includes a generally U-shaped configuration so as to partially encase or enclose the corresponding lock rods 54, 54'. Moreover, one or a pair of corresponding apertures 34, 35 may also be defined within the retention brackets 30, 30' so as to permit passage of a corresponding end of the cross brace 20 therethrough and achieve the required engagement. In this manner, the cross brace 20 effectively encloses the lock rod within the corresponding retention brackets 30, 30' and disengagement therebetween cannot be readily achieved without separation of the components or damage to one or more of the components.

Looking to the embodiment of FIG. 1A, it is seen that one or both of the retention assemblies may be integrally formed with the cross brace 20. For example, one end 24 of the cross brace 20 may include an integral, generally U-shaped configuration which engages the lock rod 54' or another portion of the cargo container. In such a configuration, the U-shaped end 24 may be passed over the lock rod 54' prior to an opposite end of the cross brace engaging a corresponding retention bracket 30. Indeed, it is also recognized that if desired, both ends of the cross brace 20 may include an integral retention assembly. In such an embodiment it is preferred that the cross brace 20 be segmented so as to allow a temporary overlap or variation in spacing between the segments, thereby allowing each of the retention assemblies to be passed over the corresponding lock rods before the cargo seal 10 is secured in place.

In order to effectively secure the retention assemblies, and accordingly the cross brace 20 in place on the container, a lock assembly is also preferably provided. The lock assembly may include any variety of configurations which effectively maintain engagement between the retention assemblies and the cargo container. In the embodiments of the Figures, the lock assembly is structured to secure the cross brace 20 to at least one of the retention assemblies, in a manner to maintain securement to the cargo container. Additionally, however, the lock assembly may be structured to secure segments of the cross brace with one another, or to secure a portion of the cargo container seal 10 to the cargo container 50 itself in a manner that would restrict disengagement unless the lock assembly is removed or the remaining components of the cargo container seal are damaged. In any such embodiment, one or more aspects of the lock assembly may be provided, such as at opposite ends of the cross brace 20 so as to further prevent any lateral movement of cross brace 20 that would lead to disengagement of the retention assemblies from the cargo container.

Looking to the illustrated embodiments, the lock assembly may be provided so as to effectuate fixed securement between the cross brace 20 and at least one of the retention brackets 30. For example, the retention bracket 30 may include a pair of flanges 33, 33' including corresponding apertures 36 where through a single use cargo seal 5 may pass. Moreover, the cross brace 20 preferably includes a corresponding aperture 22 defined therein which is aligned with the openings 36 in the flanges 33, 33' so as to provide for effective positioning of the seal 5 therethrough. In this regard, a mating end of the single use seal 5 may be integrally formed with the retention bracket 30, as at 14, or may be a separate component such as providing separate male and female ends.

Figure 2:
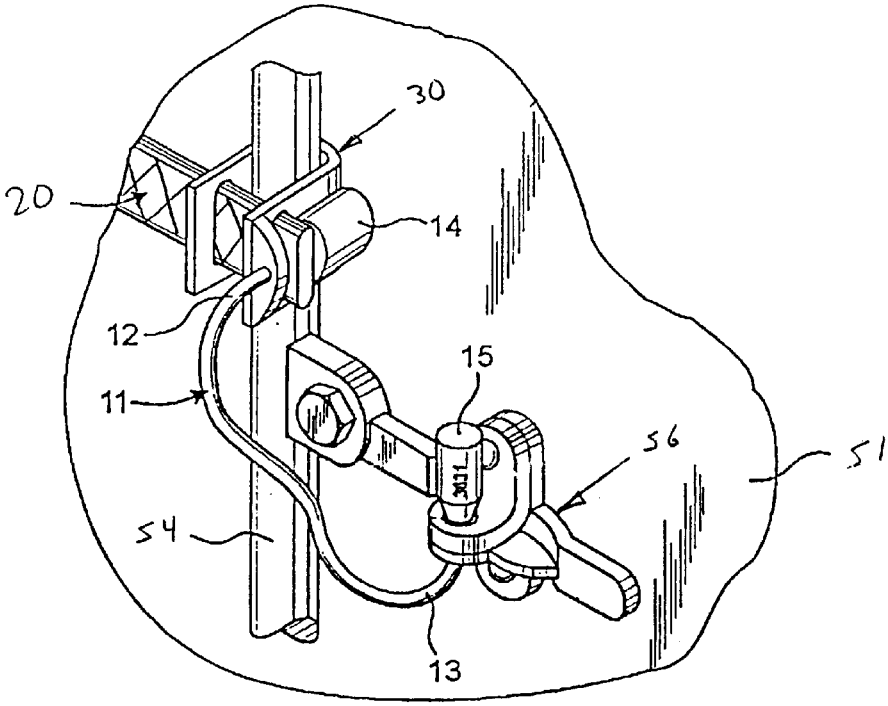
FIG. 2 is an isolated view of the door latch assembly of the cargo seal including one embodiment of the tamper evident cargo seal secured thereto.
Figure 3:
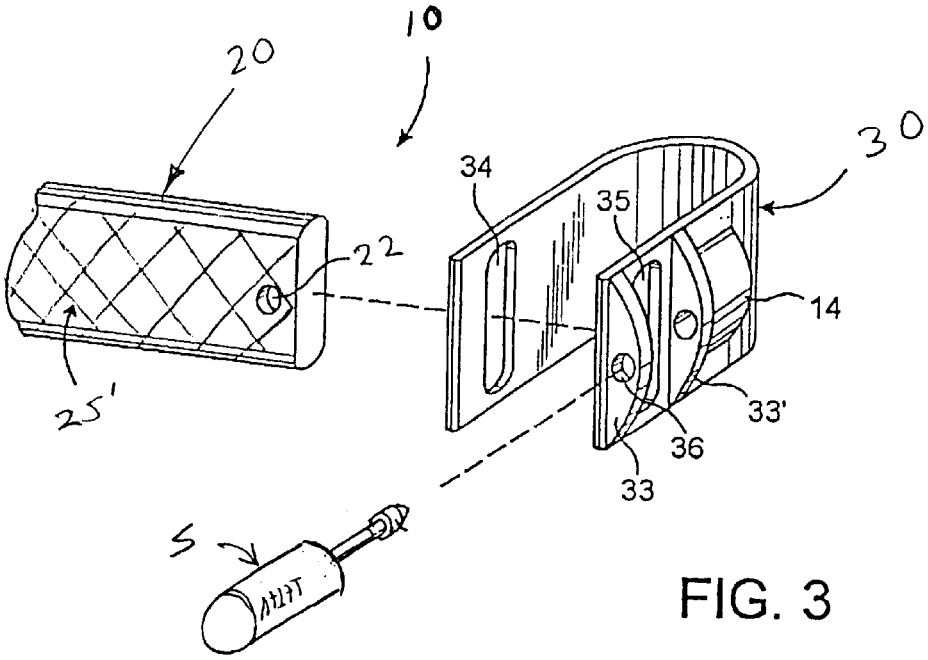
FIG. 3 is a partial exploded view of tamper evident cargo seal of the present invention.

Looking to FIG. 2, and yet another embodiment of the present invention, the lock assembly may include an elongate cable seal 11 having one end 12 of the cable seal 11 engaging the mating segment 14 disposed at the retention bracket 30, and structured to prevent disengagement between the retention bracket 30 and the cross brace 20, and an opposite end 13 of the cable seal 11 similarly passing through the sealing aperture of the container door latching structure 56. In this embodiment a large head 15 may be provided on the end 13 of the cable seal 11 and/or may be a separate component structured to be secured in place after positioning. Also, in either embodiment, whether a cable seal 11 or a more conventional single use seal 5 are utilized, a serial number is preferably disposed on one or more corresponding aspects of the lock assembly so as provide a record to be maintained by the carriers, thereby ensuring that the same seal is maintained at all times.

Figure 4:
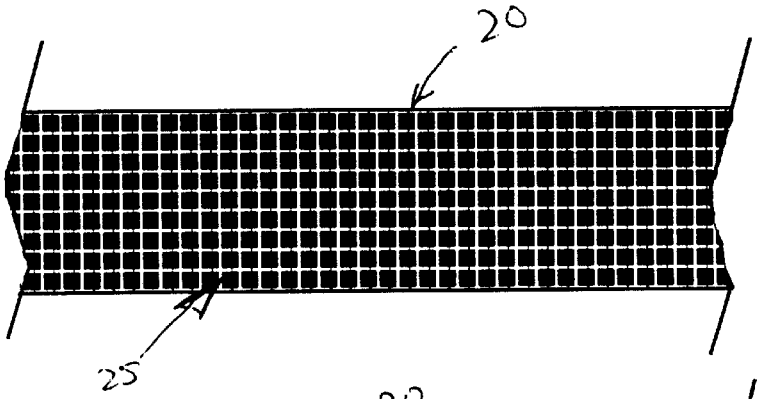
FIG. 4 is a partial front view of one embodiment of the cross brace-of the tamper evident cargo seal of the present invention.
Figure 5:
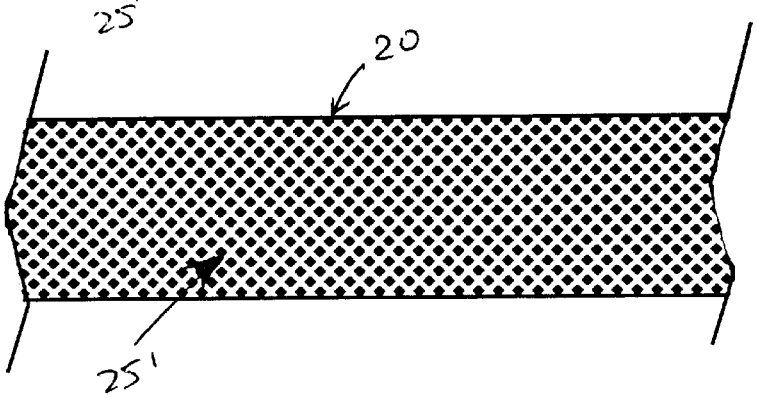
FIG. 5 is a partial front view of another embodiment of the cross brace of the tamper evident cargo seal of the present invention.
Figure 6:
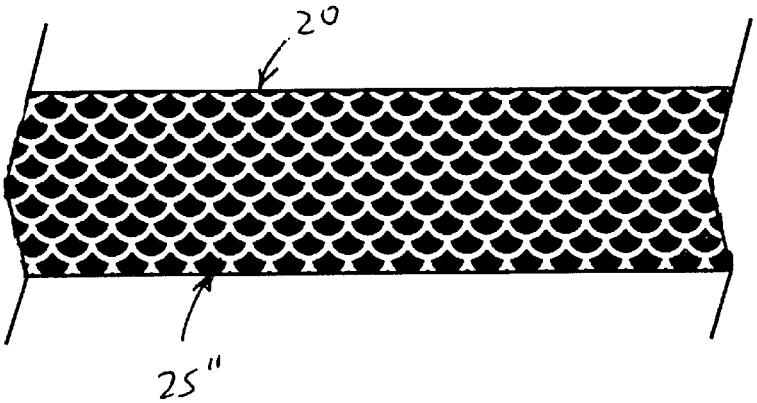
FIG. 6 is a partial front view of yet another embodiment of the cross brace of the tampered evident cargo seal of the present invention.

As indicated, the configuration of the tamper evident cargo seal 10 of the present invention is such that once it has been secured in place, the doors 51, 51' cannot be effectively opened as the cross brace 20 prevents such opening movement of the doors. Additionally, however, so as to prevent a would be thief from merely severing the cross brace 20 and/or another component such as the retention assembly(s), such as by cutting, and subsequently re-attaching the severed portions, such as by welding, the present invention further includes a continuous surface pattern 25 defined thereon. In particular, the surface pattern 25 is preferably formed in the material of cross brace 20 such as by etching, engraving, electroplating and/or by permanent painting techniques. Significantly, the continuous surface pattern 25 is preferably configured so as to provide a clear, visible indication if the cross brace 20 is cut and subsequently re-attached. For example, the continuous surface pattern may include a diamond shaped continuous surface pattern 25 as illustrated in FIG. 4, a more traditional cross hatched continuous surface pattern 25', as illustrated in FIG. 5, and/or any other alternative continuous pattern, such as the wave continuous surface pattern 25" of FIG. 6. Of course, the continuous surface pattern is preferably sufficiently complex and/or defined such that once cut it is very difficult to re-attach without visible disruption in that formed pattern. Moreover, by forming the surface pattern directly in the material of the cross brace 20, merely sanding or grinding the metal to achieve a smooth surface, and/or painting over the re-attached segments of the cross brace 20 will not suffice, as such also results in a dis-continuance of the continuous surface pattern 25 and will often still result in a contouring of the surface to indicate the presence of such a pattern beneath the paint or smoothed surface. Accordingly, thieves attempting the "inside job" will have a very difficult time returning the tamper evident cargo seal 10 of the present invention to an apparently un-tampered state if entry into the cargo container 50 is sought in a manner which does not remove the lock assembly bearing a routinely verified serial number. Also, it is contemplated that the continuous surface pattern 25 may also extend to all portions of the cross brace 20, as well as to one or both of the retention assemblies 30 so as to prevent thieves from cutting alternate portions of the tamper evident cargo seal 10 of the present invention.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described.

What is claimed is:

1. To securely close a cargo container having at least one door, a tamper evident cargo seal comprising:

a cross brace structured to span at least one perimeter edge of the door;

a pair of retention assemblies disposed a spaced apart distance from one another on opposite sides of the perimeter edge of the door and structured to engage the cargo container;

said retention assemblies cooperatively disposed with said cross brace and structured to maintain said cross brace in said spanning position across the perimeter edge of the door of the cargo container, thereby securing the door in a closed orientation;

a lock assembly structured to secure said retention assemblies in engaging relation with the cargo container;

said cross brace including a continuous surface pattern defined at least partially thereon, said surface pattern etched into said cross brace and structured to visibly indicate a severing of said cross brace therethrough and a subsequent re-attachment.

2. A tamper evident cargo seal as recited in claim 1 wherein said retention assemblies include said continuous surface pattern thereon.

3. A tamper evident cargo seal as recited in claim 1 further including a surface texturing disposed on said cross brace, said surface texturing including said continuous pattern defined therein.

4. A tamper evident cargo seal as recited in claim 1 wherein said retention assemblies include a pair of retention brackets.

5. A tamper evident cargo seal as recited in claim 4 wherein said lock assembly includes a seal structured to extend through said cross brace and at least one of said retention brackets so as to secure said retention bracket and said cross brace with one another and in secure engagement with the cargo container.

6. A tamper evident cargo seal as recited in claim 1 wherein said retention assemblies are disposed in at least partially surrounding relation to a corresponding lock rod.

7. A tamper evident cargo seal as recited in claim 1 wherein at least one of said retention assemblies is integrally formed with said cross brace.

8. A tamper evident cargo seal as recited in claim 7 wherein said retention assembly includes a generally U-shaped configuration structured to at least partially surround a corresponding lock rod.

9. To securely close a cargo container having at least one door, a tamper evident cargo seal comprising:

a cross brace structured to span at least one perimeter edge of the door;

a pair of retention assemblies disposed a spaced apart distance from one another on opposite sides of the perimeter edge of the door and structured to engage the cargo container;

said retention assemblies cooperatively disposed with said cross brace and structured to maintain said cross brace in said spanning position across the perimeter edge of the door of the cargo container, thereby securing the door in a closed orientation;

a lock assembly structured to secure said retention assemblies in engaging relation with the cargo container;

said cross brace including a continuous surface pattern defined at least partially thereon, said surface pattern engraved into said cross brace and structured to visibly indicate a severing of said cross brace therethrough and a subsequent re-attachment.

10. To securely close a cargo container having at least one door, a tamper evident cargo seal comprising:

a cross brace structured to span at least one perimeter edge of the door;

a pair of retention assemblies disposed a spaced apart distance from one another on opposite sides of the perimeter edge of the door and structured to engage the cargo container;

said retention assemblies cooperatively disposed with said cross brace and structured to maintain said cross brace in said spanning position across the perimeter edge of the door of the cargo container, thereby securing the door in a closed orientation;

a lock assembly structured to secure said retention assemblies in engaging relation with the cargo container;

said cross brace including a continuous surface pattern defined at least partially thereon, said surface pattern including a cross hatched pattern and structured to visibly indicate a severing of said cross brace therethrough and a subsequent re-attachment.

11. To securely close a cargo container having at least one door, a tamper evident cargo seal comprising:

a cross brace structured to span at least one perimeter edge of the door;

a pair of retention assemblies disposed a spaced apart distance from one another on opposite sides of the perimeter edge of the door and structured to engage the cargo container;

said retention assemblies cooperatively disposed with said cross brace and structured to maintain said cross brace in said spanning position across the perimeter edge of the door of the cargo container, thereby securing the door in a closed orientation;

a lock assembly structured to secure said retention assemblies in engaging relation with the cargo container;

said cross brace including a continuous surface pattern defined at least partially thereon, said surface pattern including a diamond pattern and structured to visibly indicate a severing of said cross brace therethrough and a subsequent re-attachment.

* * * * *